US008934321B2

(12) United States Patent
Fung

(10) Patent No.: US 8,934,321 B2
(45) Date of Patent: Jan. 13, 2015

(54) ANALOG QUARTZ TIMEPIECE AND METHOD FOR PROVIDING TIME-CORRECTION OF THE SAME

(76) Inventor: Wai Tong Fung, To Kwa Wan (HK)

( * ) Notice: Subject to any disclaimer, the term of this patent is extended or adjusted under 35 U.S.C. 154(b) by 46 days.

(21) Appl. No.: 13/579,714

(22) PCT Filed: Jun. 1, 2011

(86) PCT No.: PCT/CN2011/075112

§ 371 (c)(1),
(2), (4) Date: Aug. 17, 2012

(87) PCT Pub. No.: WO2012/162887

PCT Pub. Date: Dec. 6, 2012

(65) Prior Publication Data

US 2013/0010576 A1 Jan. 10, 2013

(51) Int. Cl.

| | |
|---|---|
| ***G04C 9/00*** | (2006.01) |
| ***G04C 11/02*** | (2006.01) |
| ***G04B 47/06*** | (2006.01) |
| ***G04B 19/26*** | (2006.01) |
| ***G04B 19/24*** | (2006.01) |
| ***G04C 17/00*** | (2006.01) |

(52) U.S. Cl.

CPC ..... *G04C 17/00* (2013.01)
USPC ..... 368/47; 368/80; 368/223

(58) Field of Classification Search

USPC ..... 368/47, 76, 80, 81, 185, 187–189, 368/220–222, 223

See application file for complete search history.

(56) References Cited

U.S. PATENT DOCUMENTS

| | | | | |
|---|---|---|---|---|
| 5,231,612 | A * | 7/1993 | Allgaier et al. | 368/47 |
| 5,479,379 | A * | 12/1995 | Tsuchiya et al. | 368/74 |
| 6,288,977 | B1 * | 9/2001 | Yoshida et al. | 368/47 |
| 6,807,128 | B2 * | 10/2004 | Yiu | 368/220 |
| 7,154,818 | B2 * | 12/2006 | Liu | 368/220 |
| 2004/0120221 | A1 * | 6/2004 | Ogasawara et al. | 368/80 |
| 2005/0002277 | A1 * | 1/2005 | Fukuda et al. | 368/80 |
| 2006/0114750 | A1 * | 6/2006 | Iida et al. | 368/67 |
| 2009/0016172 | A1 * | 1/2009 | Fujii et al. | 368/80 |
| 2009/0161120 | A1 * | 6/2009 | Kojima | 356/615 |
| 2009/0296533 | A1 * | 12/2009 | Kojima | 368/185 |
| 2009/0296534 | A1 * | 12/2009 | Kojima et al. | 368/185 |

FOREIGN PATENT DOCUMENTS

| | | | | |
|---|---|---|---|---|
| DE | 4311065 | C1 * | 2/1994 | G04C 9/02 |

OTHER PUBLICATIONS

English Translation of DE4311065C1.*

* cited by examiner

*Primary Examiner* — Amy Cohen Johnson
*Assistant Examiner* — Matthew Powell
(74) *Attorney, Agent, or Firm* — Wendy K. Marsh

(57) ABSTRACT

The invention provides an analog quartz timepiece, comprising a housing; one or more hands; a drive movement comprising gears and drive motors associated with the hands for timekeeping; a position sensor comprising a light transmitter and a light receiver positioned to define a reflective area on the dial, where the light transmitter transmits a beam of light to any one of the hands passing through the reflective area and the light receiver receives the light reflected from the passing hand; and a processor programmed to determine a position of the passing hand in the reflective area in correspondence to the reflection of the light from the hand, and to drive the movement to move the hand to a correct time position responsive to the determined position. The invention also relates to a method for providing time-correction of an analog quartz timepiece.

22 Claims, 8 Drawing Sheets

ANALOG QUARTZ TIMEPIECE AND METHOD FOR PROVIDING TIME-CORRECTION OF THE SAME

FIELD OF THE INVENTION

This invention relates generally to the field of timepieces, and more particularly to an analog quartz timepiece which allows for time-correction at a very low manufacturing cost and at a fast speed and to a method for providing such time-correction.

BACKGROUND OF THE INVENTION

A quartz timepiece such as a quartz clock is known to use an electronic oscillator that is regulated by a quartz crystal for timekeeping. This crystal oscillator creates a signal with very precise frequency, so that the quartz clock is at least in an order of magnitude and more accurate than mechanical clocks. Generally, a digital logic counts the cycles of this signal and provides a numeric time display in the format of hour, minute and second. Quartz timepieces are the most common technology of timekeeping in available clocks and watches as well as in computers and other appliances that keep time.

A radio controlled (RC) clock is the type that is synchronized by a time code bit stream transmitted by a radio transmitter connected to a time standard such as an atomic clock. The RC clock may be synchronized to the time sent by a single transmitter, such as many national or regional time transmitters, or may use multiple transmitters, like Global Positioning System. These systems can be used to set computer clocks or clock means for human readability, or for any purpose where accurate time is needed. The RC clocks synchronized to terrestrial time signals can achieve an accuracy of around 1 millisecond relative to the time standard, but are generally limited by uncertainties and variability in radio propagation.

Generally a clock can display the time by an analog clock display, a digital clock display, or both. The analog clock display includes an hour hand, a minute hand, and a second hand to display the time. The digital clock display displays the time digitally. Some markings or labels may be included on the display for example to indicate that the clock is radio controlled. The analog clock display has a clock face similar to traditional mechanical clocks, and is more popular than the digital display to some people.

A RC clock of analog display generally comprises a receiving antenna and a receiving circuit, a MCU or CPU processor, driving motors comprising a second hand motor and an hour hand and minute hand motor, gears comprising a second hand gear, a minute hand gear and an hour hand gear, and hands alignment means comprising a photoelectric transmitter and a photoelectric receiver controlled by the CPU processor which are respectively arranged above the second hand gear and below the hour hand gear. Each of the second hand gear, the minute hand gear and the hour hand gear is formed with locating holes for the purpose of time-correction.

During the synchronization process, especially for the first time when the clock is powered on, the analog RC clock aligns all hands at 12 o'clock, receives a RCC (radio controlled clock) signal from a designated RCC station having a matchable frequency through its receiving antenna and receiving circuit, decodes the signal to obtain the correct time by the MCU/CPU, then moves the hands from 12 o'clock to the respective positions indicating the correct time. For time-correction of the hands, all the hands must be positioned at "12" o'clock, and the locating holes formed on the gears should be aligned with each other until the synchronization is successfully completed by the alignment means. Namely, the light emitted by a photoelectric transmitter must simultaneously pass through all the locating holes on the respective gears and be received by the photoelectric receiver.

It takes a very long time for completing the synchronization process, which costs about a few minutes, since the hands of the analog RC clock is driven by the motors through the different gears, and both the time needed for the hands returning back to the 12'oclock for time-correction and the time needed for the hands going to the respective correct positions are quite long. Therefore it will be advantageous if time synchronization or time correction can be reduced. Moreover, cost of manufacturing the movement of the analog RC clock is high because of expensive components such as gears and drive coils which require to be machined precisely.

In some occasions, it is not required for time-correction of the second hand, the minute and the hour hand at the same time, and it is possible that only the position of second hand needs to be corrected.

Therefore, there is a need for providing a method for time-correction of an analog quartz timepiece which is not expensive and independent of the gears, and by which the second hand, the minute and/or the hour hand can be corrected separately.

SUMMARY OF THE INVENTION

The present invention has been developed to fulfill the need noted above and therefore has a principle object of the provision of an analog quartz timepiece which performs time-correction through the use of light reflection of different hands.

Another object of the invention is to provide an analog quartz timepiece which is significantly more economical and convenient for time-correction than the timepieces available in the prior art.

A yet further object of the invention is to provide an analog quartz timepiece which is able to separately correct the positions of the hands.

These and other objects and advantages of the invention are satisfied by providing an analog quartz timepiece, comprising:

a housing;

one or more hands continuously rotating around a dial placed within the housing;

a drive movement comprising gears and drive motors associated with the hands for timekeeping;

a position sensor comprising a light transmitter and a light receiver which are positioned to define a reflective area on the dial, where the light transmitter transmits a beam of light to any one of the hands passing through the reflective area and the light receiver receives the light reflected from the passing hand; and a processor connected to said drive movement and said position sensor, said processor being programmed to determine a position of the passing hand in the reflective area in correspondence to the reflection of the light from the hand, and to drive the movement to move the hand to a correct time position responsive to the determined position.

Preferably, the light transmitter and the light receiver are arranged at 3, 6, 9 or 12 o'clock along a radial direction of the dial or along a clockwise direction of the dial. In one particular embodiment, the light transmitter and the light receiver are arranged at 6 o'clock along the radial direction of the dial to define the reflective area bounded by an angle range of +/−6 degrees to cover snugly the $29^{th}$ to $31^{st}$ indicator marks. In this case, the position of the passing hand is determined according to the following equations:

$$C=\text{Boolean}\ [(Te-Ts)/2] \qquad \text{Formula:}$$

$$C=1,\ Sp=30+C=\text{position at the } 31^{st} \text{ indicator mark,}$$

$$\text{if } C=0,\ Sp=30+C=\text{position at the } 30^{th} \text{ indicator mark,}$$

wherein, Ts=start point where the hand comes into the reflective area; and

Te=end point where the hand comes out of the reflective area;

Sp=the position of the hand.

Generally, the hands comprise a second hand, a minute hand and an hour hand. The hands may further comprise hands indicative of calendar, alarm time, moon phase, time counter, temperature, pressure, UV and/or humidity, if desirable.

According to the invention, the processor identifies the hands from one another by their speeds of one revolution, when all the hands overlap at a same position of the reflective area.

In one preferred embodiment of the invention, the light transmitter is an infrared LED, and the light receiver is an infrared phototransistor.

Because the time-correction of the hands are independent of the gears of the drive movement, the processor and the position sensor may be mounted outside of the drive movement to provide the flexibility of mounting various components of the timepiece.

The timepiece may comprise a quartz crystal used as a time base for time-correction, or an antenna connected to the processor for receiving a radio controlled signal or preset global time via internet, network or the like, which is used as a time base for time correction.

It would be appreciated that the timepiece may further comprise a digital display connected to the processor to display the time digitally.

The processor may be any type that can be programmed to control the drive movement for timekeeping and initiating a time-correction process, for example a microprocessor control unit (MCU) or an integrated circuit selected from TM 8725, TM 8726, and radio-control receiver of CME6005 or UE6011.

To provide the time piece with more functions, it may further comprise one or more of circuits connected to the processor, and the circuits may be selected from the group consisting of a buzz circuit, a backlight circuit and a low-voltage detect circuit.

Another aspect of the invention is to provide a method for providing time-correction of an analog quartz timepiece, comprising the steps of:

providing a position sensor comprising a light transmitter and a light receiver which are positioned to define a reflective area on a dial of the timepiece, where the light transmitter transmits a beam of light to one or more hands passing through the reflective area and the light receiver receives the light reflected from the passing hand;

recognizing the reflection of the light from the passing hand to determine a position of the hand in the reflective area;

comparing the determined position of the hand with a correct time position provided by a time base;

driving a drive movement of the timepiece to move the hand to the correct time position upon an unequal comparison.

The step of determining the position of the passing hand comprises detecting the reflection of the light from a start point to an end point where the hand comes into and out of the reflective area. In one preferred embodiment, the light transmitter and the light receiver are arranged at 6 o'clock to define the reflective area bounded by an angle range of +/−6 degrees to cover snugly the $29^{th}$ to $31^{st}$ indicator marks, and the position of the hand is determined according to the following equations:

$$C=\text{Boolean}\ [(Te-Ts)/2] \qquad \text{Formula:}$$

$$\text{if } C=1,\ Sp=30+C=\text{position at the } 31^{st} \text{ indicator mark,}$$

$$\text{if } C=0,\ Sp=30+C=\text{position at the } 30^{th} \text{ indicator mark,}$$

wherein, Ts=start point where the hand comes into the reflective area;

Te=end point where the hand comes out of the reflective area; and

Sp=the position of the hand.

The method of the invention further comprises the step of identifying the hands from one another by their speeds of one revolution, when all the hands overlap at a same position of the reflective area. Preferably, the identifying step comprises determining a duration between start point and end point where the hand comes into and out of the reflective area to identify the hands according to the following:

Case (A): if Hand Speed [Te−Ts]>average speed of hour hand [Hs], then neglect overlapping;

Case (B): if Hand Speed [Te−Ts]=average speed of second hand [Ss]<min (minute hand, hour hand), then the hand is identified as a second hand;

Case (C): if Hand Speed [Te−Ts]=max [second hand]<average speed of minute hand [Ms]<min (hour hand), then the hand is identified as a minute hand;

Case (D): if Hand Speed [Te−Ts]=average speed of hour hand, then the hand is identified as an hour hand;

wherein Ts=start point where the hand comes into the reflective area; and

Te=end point where the hand comes out of the reflective area.

The time base comprises a quartz crystal, a radio controlled signal or a pre-loaded time stored in the timepiece.

In contrast to the analog quartz timepieces available in the prior art, the timepiece of the invention utilizes the light reflection to separately determine the positions of the hands bounded by an angle range, which in turn enables correction of the positions of the hands independent of the gears. Thus, the invention eliminates the need for all the hands to return to zero (12 o'clock) and provides a faster speed for hand positioning to correct time by about 50% than the prior art. The processor and the position sensor of the invention may be mounted outside of the drive movement, providing the flexibility of integrating the components with a LCD/LED display.

Costs of manufacturing the inventive timepiece are lower than the prior art timepieces because the expensive components, such as the gears formed with precise locating holes and large drive coils, have been eliminated. Additionally, there is no need to develop complex mold design of the drive movement and create precise holes on the gears. Therefore, total system cost will be less and better time keeping will be expected.

To have a better understanding of the invention reference is made to the following detailed description of the invention and embodiments thereof in conjunction with the accompanying drawings.

DETAILED DESCRIPTION OF THE PREFERRED EMBODIMENTS

While this invention is illustrated and described in preferred embodiments, the invention may be produced in many different configurations, sizes, forms and materials.

Figure 1:
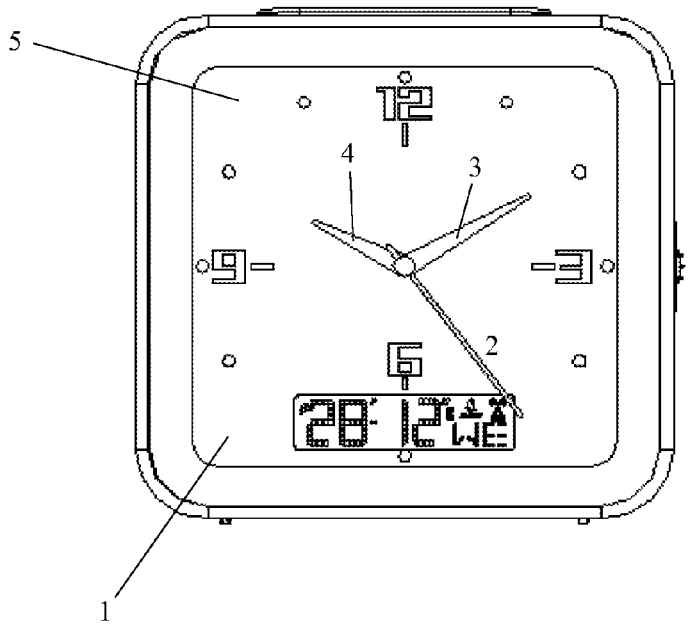
FIG. 1 is a radio controlled clock displaying the time in analog and digital manners.

Referring now to the drawings, FIG. 1 illustrates a radio controlled (RC) clock 1 which both displays the analog time and the digital time. The inventive concept of the invention will be described with reference to this RC clock 1. It should be noted that the clock 1 may be any type of analog quartz clocks and watches including one or more hands, and optionally one of more digital displays.

As illustrated, the RC clock 1 comprises a housing in which a dial 5 and three hands including a second hand 2, a minute hand 3 and an hour hand 4, and a digital display are arranged. The dial 5 and the three hands form an analog clock face. It would be within the ability of a person skilled in the art that the clock may comprise two hands (i.e. a minute hand and an hour hand) only, or comprise additional hands indicative of the date, the moon phase, the weekday, and the like. The dial 5 indicates the time with numeral indicator marks or with non-numeric indicator marks. The digital display may be optionally incorporated into the analog timepiece.

Figure 2:
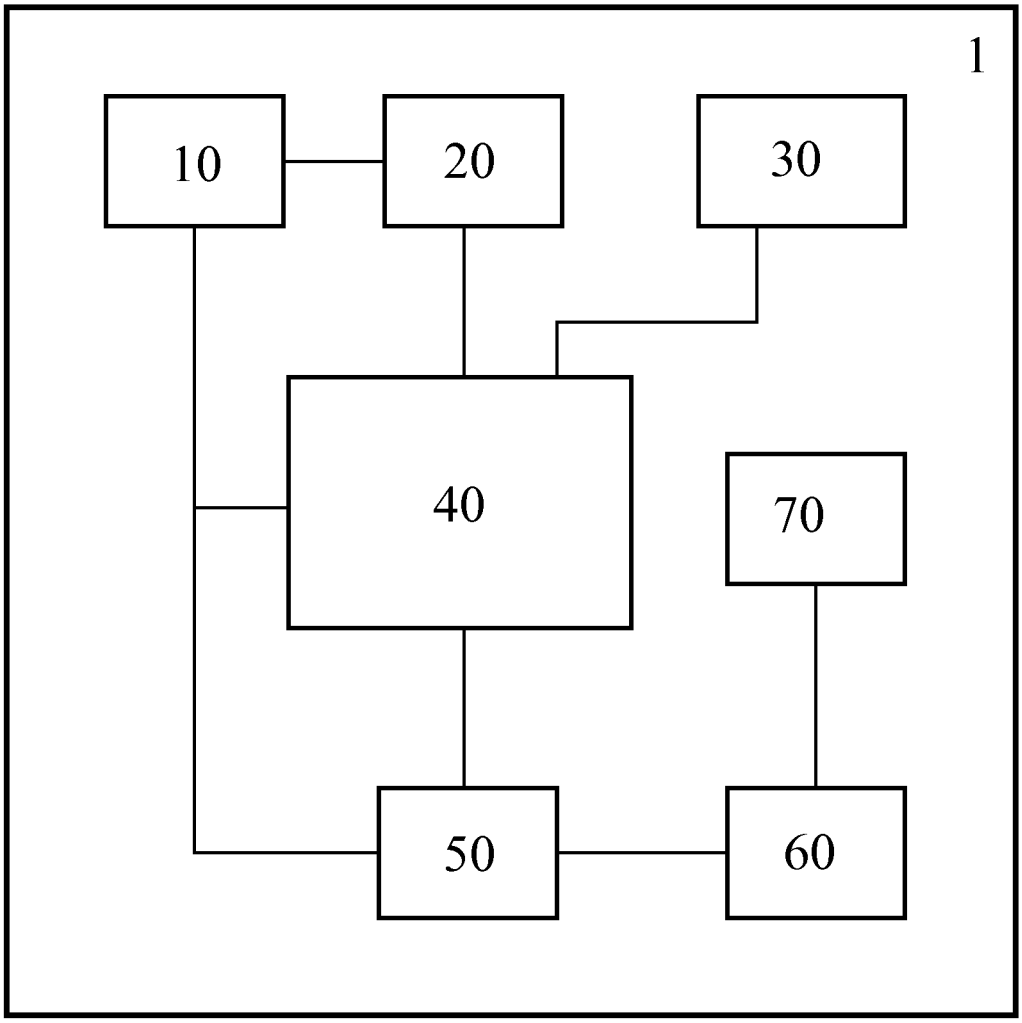
FIG. 2 is a schematic view of a block diagram of a radio controlled clock.

As shown in FIG. 2, the RC clock 1 comprises a battery 10 for providing a power supply to the clock, a quartz oscillator 20 providing an oscillator signal, an antenna 30 for receiving a radio control synchronization signal, a microprocessor control unit (MCU) 40 for controlling the drive movement of the clock for timekeeping. The drive movement comprises a motor or motors 50 to drive the gears 60 associated with hands 70. The hands 70 refer to the second hand 2, the minute hand 3 and the hour hand 4 shown in FIG. 1.

Apart from the use of the antenna 30, the MCU 40 may also comprise a preloaded time or a quartz crystal used as a time base for time-correction purpose.

As discussed above, the RC clock of prior art comprises a light transmitter and a light receiver which are provided within the movement for the alignment of the holes formed on the gears to align all the hands 70 at 12 o'clock. One of the improvements of the invention is the arrangement of a position sensor comprising an infrared light transmitter 8 and an infrared light receiver 7, which may be implemented by an infrared LED (light emitting diode) and a phototransistor, respectively. In particular, the light transmitter 8 and the light receiver 7 are arranged behind the dial 5 of the clock and positioned to define a reflective area on the dial 5, where the light transmitter transmits a beam of light to any one of the hands 70 passing through the reflective area and the light receiver receives the light reflected from the passing hand. As opposed to the prior art which performs the time-correction process only at the position of 12 o'clock due to the intrinsic gear construction, the light transmitter 8 and the light receiver 7 of the invention can be mounted at any position of the dial 5, for example at the position of 3, 6 or 9 o'clock.

Figure 3A:
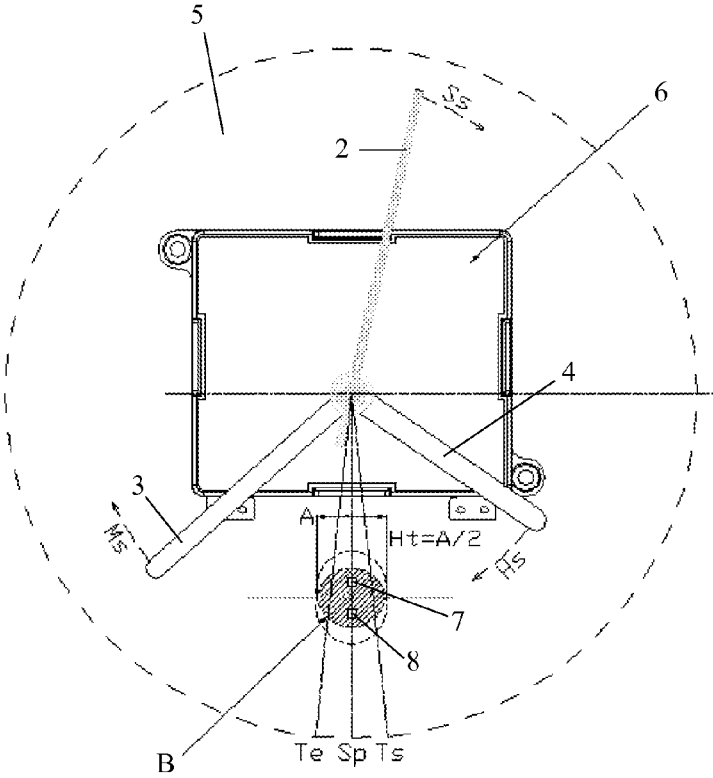
FIG. 3A is a schematic view of a dial and a drive movement of a clock according to one embodiment of the invention.
Figure 3B:
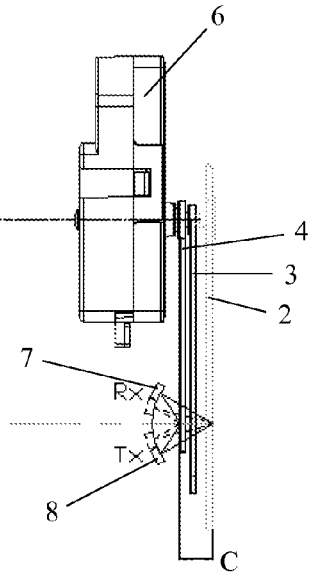
FIG. 3B is a sectional view of the dial and the movement of FIG. 3A.

FIGS. 3A and 3B provides an exemplary dial 5 and a drive movement 6 of the invention. As illustrated, the light transmitter 8 and the light receiver 7 are arranged at 6 o'clock along a radial direction of the dial. Alternatively, the light transmitter 8 and the light receiver 7 may be arranged along a clockwise direction of the dial. In this embodiment, the light transmitter (Tx) 8 and the light receiver (Rx) 7 are tilted respectively at 30 degrees with respect to a central line therebetween to define the reflective area. This reflective area is bounded exactly by an angle range of +/−6 degrees to cover the $29^{th}$ to $31^{st}$ indicator marks. The IR beam of light transmitted by the light transmitter (Tx) 8 will be reflected by a bottom surface of the hand passing through the detection area C toward the light receiver (Rx) 7.

Referring to FIG. 3A, the circle having a center where the light transmitter 8 is located represents the area that may be irradiated by the light transmitter, the circle having a center where the light receiver 7 is located represents the area detectable by the light receiver, and the shaded area B represents the reflective area where the light transmitted by the light transmitter 8 can be reflected by the hands 2, 3 and 4 and received by the light receiver 7. The width of the shaded area B is expressed as "A". It is noted that the two circles and the shaded area are provided for illustrative purpose and not shown on the dial of the clock. The light transmitter 8 and the light receiver 7 may be embedded within the dial 5, and thus invisible.

Now, the second hand 2 is taken as an example to illustrate the time-correction process of the invention.

Normally, the second hand 2 rotates in a clockwise direction around the dial 5 and is driven by a motor and gears associated with the second hand to jump once every second. In FIG. 3A, the reflective area B is defined to bound an angle of +/−6 degree relative to the $30^{th}$ indicator mark to cover snugly the $29^{th}$ to $31^{st}$ indicator marks. The bounding of the reflective area B can be achieved by arranging the transmitter (Tx) 8 and the receiver (Rx) 7 relative to the central line therebetween by about +/−30 degrees, which defines the detection area C as shown in FIG. 3B.

When the second hand 2 jumps from the $29^{th}$ indicator mark to the $30^{th}$ indicator mark, it comes into the reflective area B; when the second hand 2 jumps from the $31^{st}$ indicator mark to the $32^{nd}$ indicator mark, it comes out of the reflective area B. Due to the arrangement of the IR light transmitted by the transmitter 8 and received by the receiver 7, it is possible to detect if the second hand is in the reflective area B and to detect the start time point when it comes into the reflective area B and the end time point when it comes out of the reflective area B. The following formula can be used to locate the position of second hand (Sp):

$$C=\text{Boolean}\ [(Te-Ts)/2] \qquad \text{Formula: (1)}$$

$$\text{if } C=1,\ Sp=30+C=\text{position at the } 31^{st} \text{ indicator mark,} \qquad (2)$$

$$\text{if } C=0,\ Sp=30+C=\text{position at the } 30^{th} \text{ indicator mark,} \qquad (3)$$

wherein, Ts=start point where the hand comes into the reflective area; and

Te=end point where the hand comes out of the reflective area;

Sp=the position of the hand.

It is noted that the second hand 2 requires two seconds to pass through the reflective area B covering the area from the $29^{th}$ indicator mark to the $31^{st}$ indicator mark, it takes two minutes for the minute hand 3 to do so and two hours for the hour hand 4 to do so. If any one of the hands 2, 3, 4 is presented in the reflective area B, the light transmitted from the transmitter 8 is reflected by the hand and then received by the receiver 7. If no hand passes through the reflective area B, no light reflection takes place. The time duration from the start point where the receiver 7 starts to detect the light reflection, to the end point where the receiver 7 receives no light reflection, is equal to the time duration during which the detected hand passes through the reflective area. Obtaining this time duration enables the calculation of the speed of the detected hand, which in turn allows for the determination of the position of the detected hand. At the midpoint of the time duration, the detected hand should be positioned at the $30^{th}$ indicator mark. According to the above time duration, the MCU 40 can determine the actual position of the detected hand.

It is possible that all the hands overlap at the same position in the reflective area, for example, the minute hand 3 and the second hand 2 may overlap at the $30^{th}$ indicator mark when the second hand 2 is detected. In order to solve this overlapping problem, the different speeds of the hands may be taken to identify the hands from one another using one position sensor only. In particular, the hands can be identified according the following with reference to FIG. 3A:

Case (A): if Hand Speed [Te−Ts]>average speed of hour hand [Hs], then neglect overlapping;

Case (B): if Hand Speed [Te−Ts]=average speed of second hand [Ss]<min (minute hand, hour hand), then the hand is identified as a second hand;

Case (C): if Hand Speed [Te−Ts]=max [second hand]<average speed of minute hand [Ms]<min (hour hand), then the hand is identified as a minute hand;

Case (D): if Hand Speed [Te−Ts]=average speed of hour hand, then the hand is identified as an hour hand;

wherein Ts=start point where the hand comes into the reflective area; and

Te=end point where the hand comes out of the reflective area.

The width of the hand Ht may be varied according to the coverage of the reflective area B and the relative angle of the light transmitter 8 to the light receiver 7. Generally, the width of the hand Ht is equal to or less than half of the width A of the reflective area B for better detection.

It would be appreciated that the clock 1 can include additional hands indicative of the date, the alarm time, the moon phase, the weekday, and the like. The positions of these additional hands may be detected and determined in the same way, and the MCU 40 may perform the similar time-keeping and time-correction operations as discussed above.

As with the prior art, the clock 1 of the invention uses a time base for the time correction. The time base can be any type known in the art, for example a quartz crystal, a RCC signals, or preloaded time stored in the MCU 40.

When the light reflection signal is received, decoded and recognized by the MCU 40, the MCU 40 can determine the actual position of the detected hand according to the above time duration. With the actual position of the detected hand, the MCU 40 can then determine if the time of the detected hand is correct, i.e. if the time of the detected hand is synchronized with the time base. In the case of the incorrect time, the MCU 40 activates the gears of the drive movement associated with the detected hand to move the detected hand to the correct position.

Figure 4:
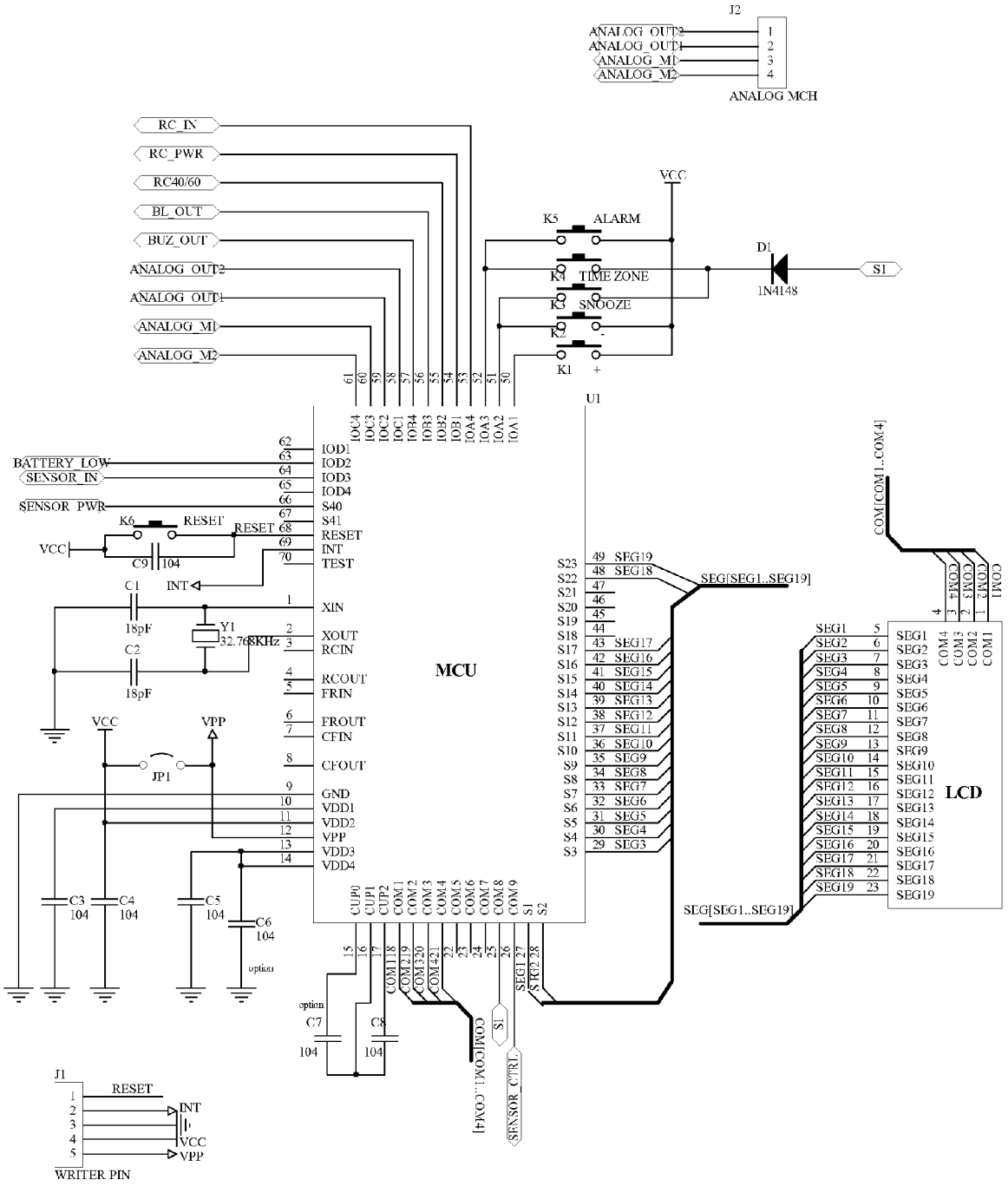
FIG. 4 is a circuit of the clock that is used in one embodiment of the invention.
Figure 5A:
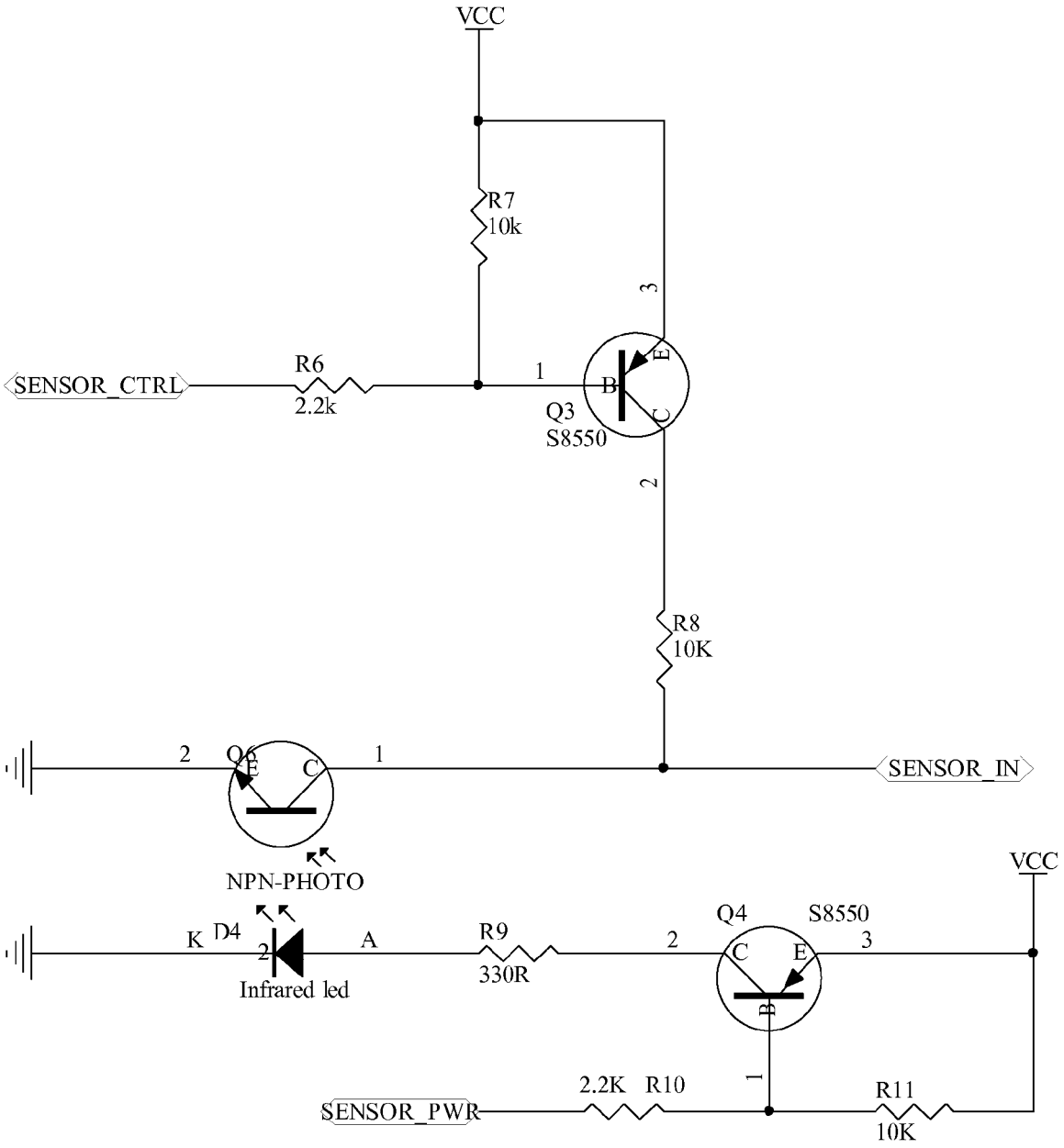
FIG. 5A is a circuit of a position sensor that is used in one embodiment of the invention.

FIG. 4 shows the circuit of the MCU 40 according to one embodiment of the invention, and FIG. 5A shows the circuit of the position sensor according to one embodiment of the invention, both of which form the basic electronic circuits of the analog quartz clock of the invention. FIGS. 5B, 6A, 6B and 6C show additional circuits which may be incorporated into the clock to enhance the various functions.

As illustrated in FIG. 4, the MCU 40 is implemented as an integrated circuit called TM 8725 or TM 8726 by Tenx Technology Inc., or CME6005, UE6011 by C-MAX Company, HKW-Elektronik GmbH or etc. The MCU 40 is designed to receive a RCC signal from the terminals RC_in, RC_pwr and RC 40/60 connected to the antenna. The MCU 40 controls the drive movement via J2 terminals of the clock for time keeping and time correction. The MCU 40 also can deliver a signal to a LCD or LED display panel to display the time digitally. The MCU 40 is connected to receive an Internet time from the terminals of J1 receiving the preset time before ex-factory or sale.

FIG. 5A shows one exemplary electronic circuit of the position sensor comprising the light transmitter 8 and the light receiver 7. The Infrared LED D6 corresponds to the light transmitter 8 and the Phototransistor Q7 corresponds to the light receiver 7. The terminals SENSOR_CTRL, SENSOR_PWR and SENSOR_IN in this figure are connected to respective terminals of the MCU 40.

Figure 5B:
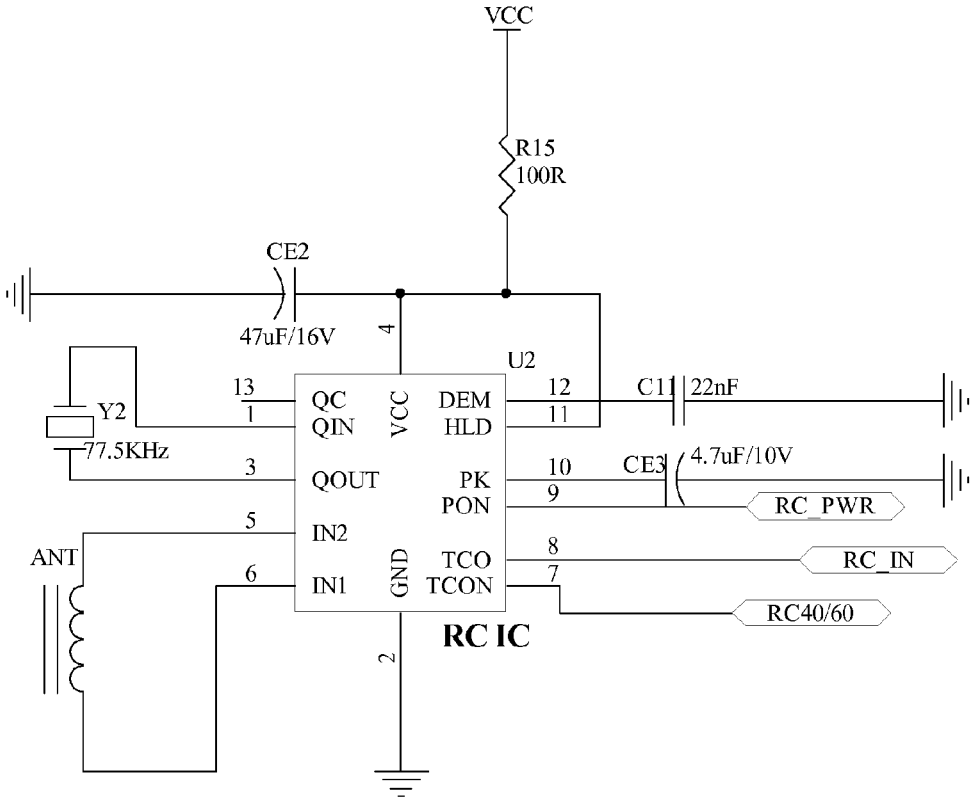
FIG. 5B is a radio controlled clock receiver circuit this is used in one embodiment of the invention.

FIG. 5B shows one exemplary radio controlled clock receiver circuit which is incorporated into the clock of the invention. The circuits of FIG. 4, FIG. 5A and 5B form a radio controlled clock constructed according to one embodiment of the invention. The RC IC is not the essence of the invention and well known in the art, thus is not elaborated herein.

Figure 6A:
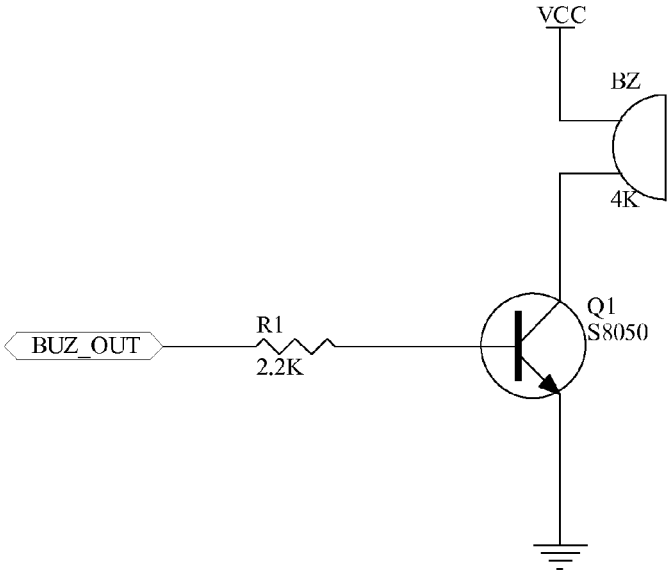
FIGS. 6A, 6B and 6C are additional circuits which are incorporated into the clock according to one embodiment of the invention.
Figure 6B:
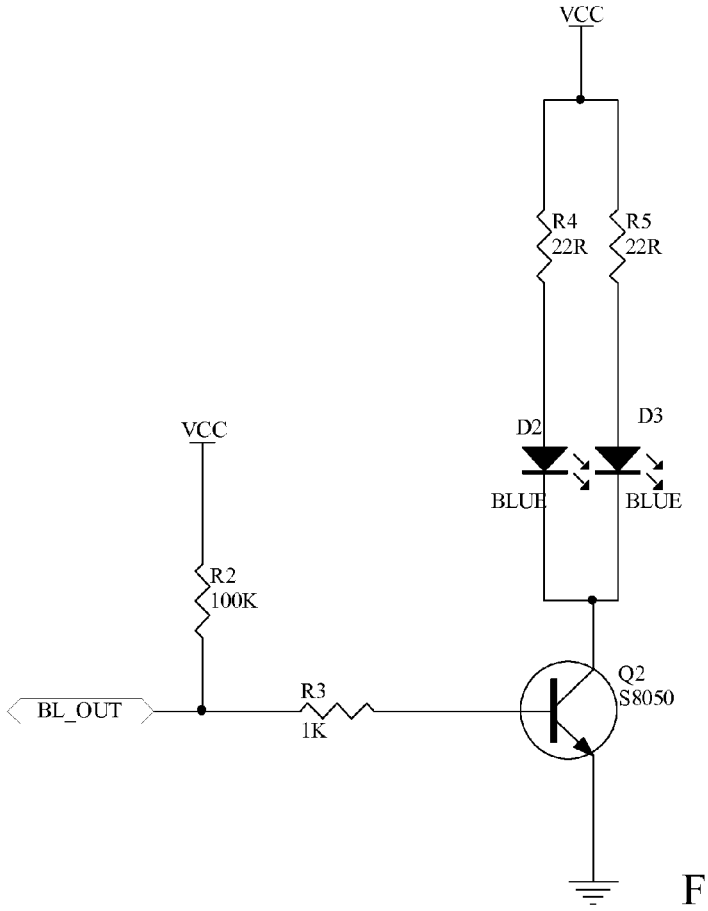
Figure 6C:
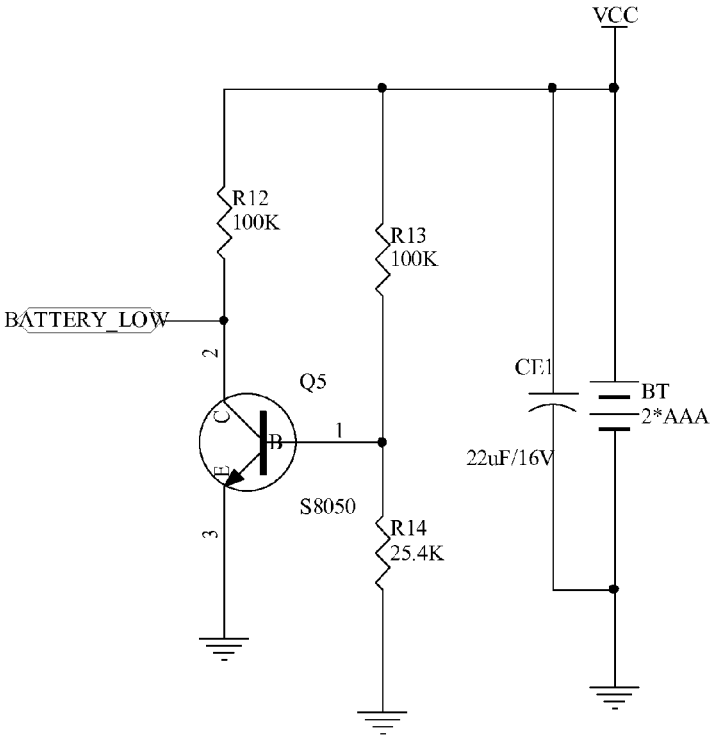

FIG. 6A is a buzz circuit having an input connected to the BUZ_OUT terminal of the MCU 40. FIG. 6B is a backlight circuit adapted to the clock and having an input connected to the BACKLIGHT_OUT terminal of the MCU 40. FIG. 6C is a low-voltage detected circuit of the clock to detect if the battery is in low energy condition, which has an input connected to the BATTERY_LOW terminal of the MCU 40.

According to the invention, 1.5V or 3V DC may be used as the power supply and provided as two "AA" or "AAA" size batteries having 1.5 VDC output each.

Figure 7:
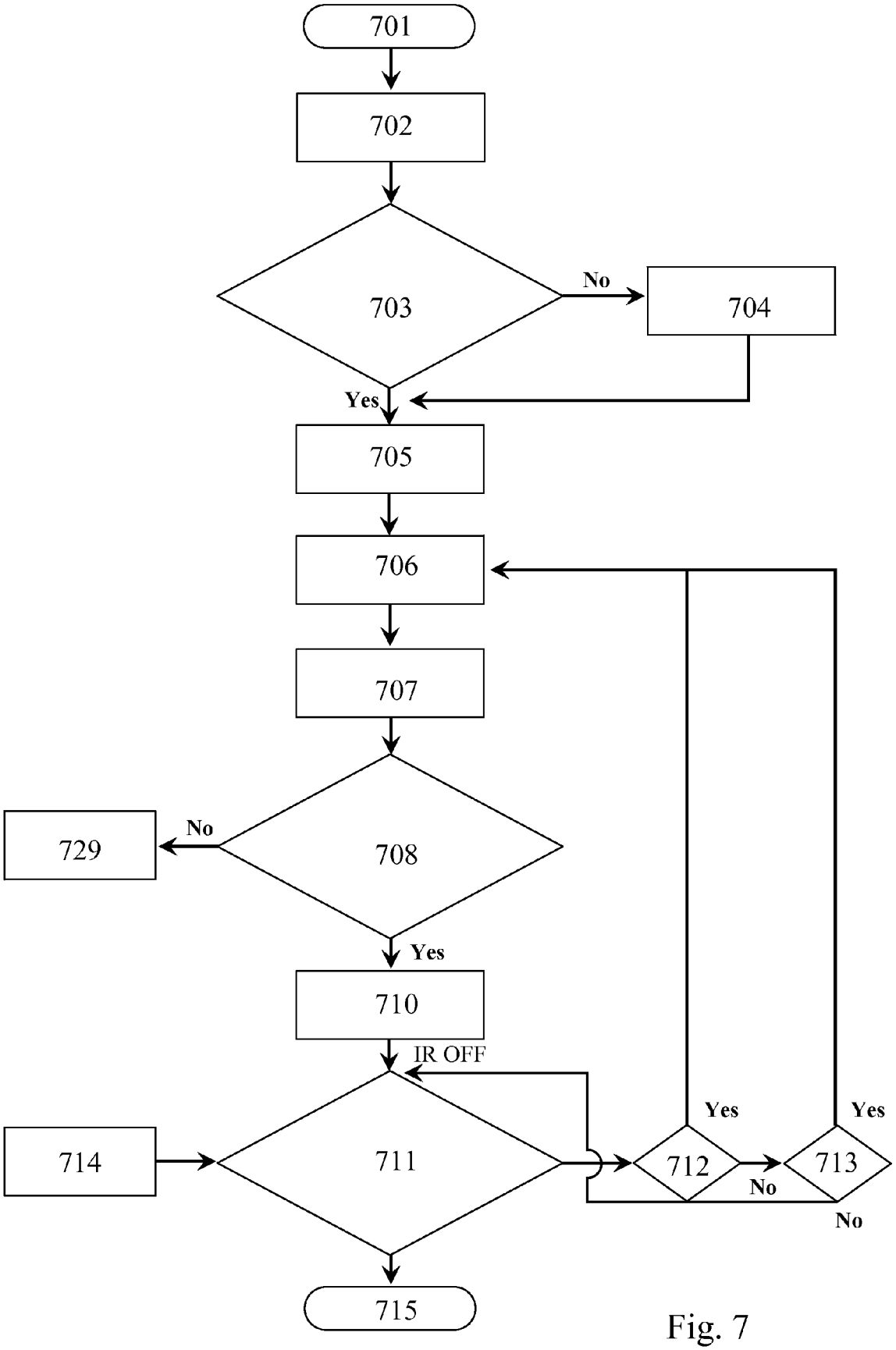
FIG. 7 is a flow chart of operating the clock according to one embodiment of the invention.

FIG. 7 is a flow chart showing the operation of the clock. The operation process of FIG. 7 correspond to the clock comprising all the circuits of FIGS. 4, 5 and 6A-6C.

The operation of the clock starts with step 701. In step 702, the clock is powered-on or reset; then in step 703, the clock receives a radio controlled clock (RCC) signal, or set time manually, or read the preloaded time stored in the MCU 40, which is used as the time base for the correct time. If in step 703, the clock fails to obtain the correct time, the clock will be set to a default time for example 12 o'clock in step 704.

If the clock gets the correct time in step 703 and the clock comprises a LCD display, the operation goes to step 705 to enable the LCD displays the digital time. Then the operation goes to step 706 to move the hand to the correct position according to the correct time shown on the LCD. Then in step 707, the light transmitter 8 and the receiver 7 are initiated to detect the position of the hands 2, 3, 4 rotating around the dial 5.

In step 708, the clock will identify the detected hands overlapping in the reflective area according to the rotation speed of one revolution of the detected hand. If step 708 fails to identify any one of the three hands, the signal "Err" will be displayed on the LCD to indicate that there is an error of identifying the hands. If the respective actual positions of the three hands are determined in step 708, the MCU 40 will activate the drive movement of the clock for time correction upon an unequal comparison in step 710, for example to synchronize the analog time of the hands to the time shown on the LCD. After the time correction process, the light transmitter 8 and the receiver 7 will be switched off, and the MCU resumes the normal time-keeping operation in step 711.

Step 714 represents the additional functions of low battery/voltage detection, alarm, LED backlight, scanning or the like. Step 712 will detect if the time is changed, and if yes, goes to step 706 to resume the time-correction process; and if not, goes to step 713 to check if it is the time to receive the RCC signal periodically (e.g. daily or weekly). If it is the time to receive the RCC signal in step 713, go to step 706; and if not, go back to step 711. The operation of the clock ends in step 715.

Figure 8:
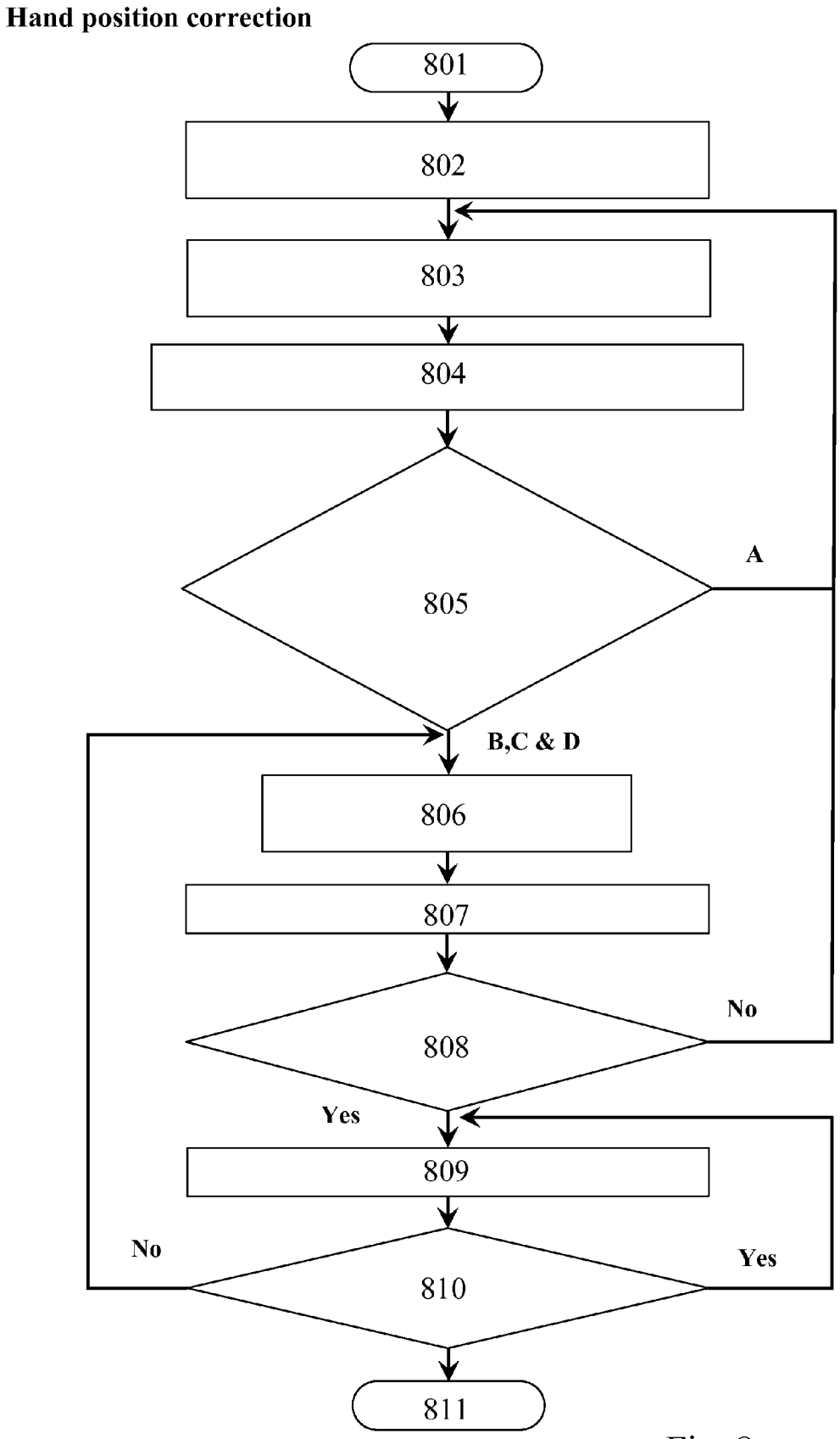
FIG. 8 is a flow chart of correcting the hand positions of the clock according to one embodiment of the invention.

FIG. 8 is a flow chart of correcting the hand positions of the clock according to one embodiment of the invention, which may become more apparent with reference to FIGS. 3A and 3B. This starts with step 801 followed by step 802 in which the correct time corresponding to the respective target positions of hands is stored. In step 803, the second hand and the minute hands run fast at the different speeds, then the IR light transmitter 8 and the receiver 7 are enabled. In step 804, the start time point (Ts) and the end time point (Te) of the detected hand passing through the reflected area B (see FIG. 3A) are detected. In step 805 the time duration between Ts and Te is calculated and compared with the correct duration of the detected hand.

If the comparison of step 805 results in Case A, go back to step 803, and if the comparison of step 805 results in Cases B, C and D, go to step 806 to report the actual position of the detected hand, and then calculate and compare the offset between the actual time corresponding to the actual position and the stored time, where Cases A, B, C and D are designated to the cases discussed above to determine if there is any hands overlapping. In case that the comparison is unequal, the MCU will initiate the time-correction process as discussed hereinabove.

The hand is moved to the correct position and then stopped in step 807. In step 808, the time-correction process is repeated until all of the hands are moved to the respective correct positions. If not all the positions of the hands are corrected in step 808, go back to step 803; otherwise go to step 809 to keep the normal rotation of all the hands. Step 810 will switch on the light transmitter 8 and the receiver 7 to detect and correct the positions of the hands periodically, e.g. daily or weekly. If the light transmitter 8 and the receiver 7 are switched on in step 810, go to step 809, otherwise go to step 806. The operation of correcting the hand positions ends in step 811.

Thus, the invention has provided an analog quartz timepiece in which the time-correction process utilizing the light reflection is included. The time-correction process of the invention is capable of detecting and correcting the positions of all the hands of the timepiece using one optical position sensor at a very fast speed. Cost of manufacture of the timepiece of the invention is much lower than the prior art, because the position sensor and the MCU operate independently from the drive movement and can be mounted outside the drive movement, which eliminate the manufacture of precisely machined gears and associated expensive components.

While the embodiments described herein are intended as exemplary analog timepiece, it will be appreciated by those skilled in the art that the present invention is not limited to the embodiments illustrated. Those skilled in the art will envision many other possible variations and modifications by means of the skilled person's common knowledge without departing from the scope of the invention, however, such variations and modifications should fall into the scope of this invention.

What is claimed is:

1. An analog quartz timepiece, comprising:

a housing;

one or more hands continuously rotating around a dial placed within the housing, the dial having sixty evenly spaced minute and/or second indicator marks thereon;

a drive movement comprising gears and drive motors associated with the hands for timekeeping;

a position sensor comprising a light transmitter and a light receiver which are positioned to define a reflective area bound by an angle range of +/−6 degrees to cover consecutive three minute or second indicator marks on the dial, said three minute or second indicator marks corresponding to start point, middle point and end point where the hands pass through the reflective area, where the light transmitter transmits a beam of light to any one of the hands passing through the reflective area and the light receiver receives the light reflected from the passing hand, wherein the start point is a point where the hand comes into the reflective area, the end point is a point where the hand comes out of the reflective area, and the middle point is a halfway point between the start point and the end point in the reflective area; and a processor connected to said drive movement and said position sensor, said processor being programmed to determine a position of the passing hand in the reflective area in correspondence to the reflection of the light from the hand, and to drive the movement to move the hand to a correct time position responsive to the determined position, and wherein the position of the passing hand is determined according to the following equations:

Formula:

$C$=Boolean $[(Te-Ts)/2]=0$ or 1 if $C=1$, $Sp$=position of the passing hand at the middle point plus $C$=position of the passing hand at the end point, if $C=0$, $Sp$=position of the passing hand at the middle point plus $C$=position the passing hand at the end point or the start point, wherein, Ts=the time at the start point where the hand comes into the reflective area; and Te=the time at the end point where the hand comes out of the reflective area;

Sp=the position of the passing hand.

2. The analog quartz timepiece as claimed in claim 1, wherein the light transmitter and the light receiver are arranged at 3, 6, 9 or 12 o'clock along a radial direction of the dial or along clockwise or anti-clockwise direction of the dial.

3. The analog quartz timepiece as claimed in claim 2, wherein the light transmitter and the light receiver are arranged at 6 o'clock along the radial direction of the dial, and the reflective area is bound by $29^{th}$ to $31^{st}$ minute or second indicator marks on the dial.

4. The analog quartz timepiece as claimed in claim 3, the position of the passing hand is deteunined according to the following equations:

Formula:

$C$=Boolean $[(Te-Ts)/2]=0$ or 1 if $C=1$, $Sp$=position of the passing hand at the $30^{th}$ minute or second indicator mark plus $C$=position of the passing hand at the $31^{st}$ minute or second indicator mark, if $C=0$, $Sp$=position of the passing hand at the $30^{th}$ minute or second indicator mark plus $C$=position of the passing hand at the $30^{th}$ minute or second indicator mark, wherein, Ts=the time at the start point where the hand comes into the reflective area; and Te=the time at the end point where the hand comes out of the reflective area;

Sp=the position of the passing hand.

5. The analog quartz timepiece as claimed in claim 1, wherein the hands comprise a second hand, a minute hand and an hour hand.

6. The analog quartz timepiece as claimed in claim 5, wherein the hands further comprises hands indicative of calendar, alarm time, moon phase, time counter, temperature, pressure, UV and/or humidity.

7. The analog quartz timepiece as claimed in claim 1, wherein the processor identifies the hands from one another by their speeds of one revolution, when all the hands overlap at a same position of the reflective area.

8. The analog quartz timepiece as claimed in claim 1, wherein the light transmitter is an infrared LED, and the light receiver is an infrared phototransistor.

9. The analog quartz timepiece as claimed in claim 1, wherein the processor and the position sensor are mounted outside of the drive movement.

10. The analog quartz timepiece as claimed in claim 1, wherein the timepiece comprises a quartz crystal used as a time base for time-correction.

11. The analog quartz timepiece as claimed in claim 1, wherein the timepiece comprises an antenna connected to the processor for receiving a radio controlled signal or preset global time via Internet or Network, which is used as a time base for time correction.

12. The analog quartz timepiece as claimed in claim 1, wherein the timepiece further comprises one or more digital displays connected to the processor to display digitally the information relating to calendar, alarm time, moon phase, time counter, temperature, pressure, UV and/or humidity.

13. The analog quartz timepiece as claimed in claim 1, wherein the processor is a microprocessor control unit (MCU).

14. The analog quartz timepiece as claimed in claim 1, wherein the processor is an integrated circuit selected from TM 8725, TM 8726, CME6005 or UE6011.

15. The analog quartz timepiece as claimed in claim 1, wherein the time piece further comprises one or more of circuits connected to the processor and selected from the group consisting of a buzz circuit, a backlight circuit and a low-voltage detect circuit.

16. A method for providing time-correction of an analog quartz timepiece, comprising the steps of:

providing a position sensor comprising a light transmitter and a light receiver which are positioned to define a reflective area bound by an angle range of +/−6 degrees to cover consecutive three minute or second indicator marks on a dial of the timepiece having sixty evenly spaced minute and/or second indicator marks thereon, said three minute or second indicator marks corresponding to start point, middle point and end point where the hands pass through the reflective area, where the light transmitter transmits a beam of light to one or more hands passing through the reflective area and the light receiver receives the light reflected from the passing hand, wherein the start point is a point where the hand comes into the reflective area, the end point is a point where the hand comes out of the reflective area, and the middle point is a halfway point between the start point and the end point in the reflective area;

recognizing the reflection of the light from the passing hand to determine a position of the hand in the reflective area according to the following equations:

$C$=Boolean $[(Te-Ts)/2]=0$ or 1 Formula:

if $C=1$, $Sp$=position of the passing hand at the middle point plus $C$=position at the end point, if $C=0$, $Sp$=position of the passing hand at the middle point plus $C$=position at the end point or the start point, wherein, Ts=the time at the start point where the hand comes into the reflective area; and Te=the time at the end point where the hand comes out of the reflective area;

Sp=the position of the passing hand;

comparing the determined position of the hand with a correct time position provided by a time base;

driving a drive movement of the timepiece to move the hand to the correct time position upon an unequal comparison.

17. The method as claimed in claim 16, wherein determining the position of the passing hand comprises detecting the reflection of the light from a start point to an end point where the hand comes into and out of the reflective area.

18. The method as claimed in claim 17, wherein the light transmitter and the light receiver are arranged at 6 o'clock and the reflective area is bound by $29^{th}$ to $31^{st}$ minute or second indicator marks, and the position of the hand is determined according to the following equations:

$C$=Boolean $[(Te-Ts)/2]=0$ or 1 Formula:

if $C=1$, $Sp$=position of the passing hand at the $30^{th}$ minute or second indicator mark plus $C$=position of the passing hand at the $31^{st}$ minute or second indicator mark, if $C=0$, $Sp$=position of the passing hand at the $30^{th}$ minute or second indicator mark plus $C$=position of the passing hand at the $30^{th}$ minute or second indicator mark, wherein, Ts=the time at the start point where the hand comes into the reflective area;

Te=the time at the end point where the hand comes out of the reflective area; and Sp=the position of the passing hand.

19. The method as claimed in claim 16, further comprising the step of identifying the hands from one another by their speeds of one revolution, when all the hands overlap at a same position of the reflective area.

20. The method as claimed in claim 19, wherein the identifying step comprises determining a duration between start point and end point where the hand comes into and out of the reflective area to identify the hands according to the following:

Case (A): if Hand Speed [Te−Ts]>average speed of hour hand [Hs], then neglect overlapping;

Case (B): if Hand Speed [Te−Ts]=average speed of second hand [Ss]<min (minute hand, hour hand), then the hand is identified as a second hand;

Case (C): if Hand Speed [Te−Ts]=max [second hand]<average speed of minute hand [Ms]<min (hour hand), then the hand is identified as a minute hand;

Case (D): if Hand Speed [Te−Ts]=average speed of hour hand, then the hand is identified as an hour hand;

wherein Ts=start point where the hand comes into the reflective area; and

Te=end point where the hand comes out of the reflective area.

21. The method as claimed in claim 16, wherein the light transmitter is an infrared LED, and the light receiver is an infrared phototransistor.

22. The method as claimed in claim 16, wherein the time base comprises a quartz crystal, a radio controlled signal or a pre-loaded time stored in the timepiece.

* * * * *